US009121298B2

(12) United States Patent
Lee et al.

(10) Patent No.: US 9,121,298 B2
(45) Date of Patent: Sep. 1, 2015

(54) FINNED SEAL ASSEMBLY FOR GAS TURBINE ENGINES

(75) Inventors: Ching-Pang Lee, Cincinnati, OH (US); Kok-Mun Tham, Oviedo, FL (US); John M. Owen, Bath (GB); Gary D. Lock, Bath (GB); Carl M. Sangan, Camerton (GB); Vincent P. Laurello, Hobe Sound, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 273 days.

(21) Appl. No.: 13/534,060

(22) Filed: Jun. 27, 2012

(65) Prior Publication Data

US 2014/0003919 A1 Jan. 2, 2014

(51) Int. Cl.
*F04D 11/00* (2006.01)
*F01D 11/00* (2006.01)

(52) U.S. Cl.
CPC ..... *F01D 11/001* (2013.01)

(58) Field of Classification Search
USPC ..... 277/412, 417–419; 415/135, 173.7, 415/177, 200
See application file for complete search history.

(56) References Cited

U.S. PATENT DOCUMENTS 4,425,079 A 1/1984 Speak et al.
5,358,374 A * 10/1994 Correia et al. ..... 415/47
6,152,690 A 11/2000 Tomita et al.
6,506,016 B1 1/2003 Wang
6,558,114 B1 5/2003 Tapley et al.
7,189,055 B2 3/2007 Marini et al.
7,244,104 B2 * 7/2007 Girgis et al. ..... 416/193 A
2004/0265118 A1 * 12/2004 Naik et al. ..... 415/116
2010/0074730 A1 3/2010 Liang
2010/0074733 A1 * 3/2010 Little ..... 415/173.5
2010/0074734 A1 * 3/2010 Little ..... 415/173.7

OTHER PUBLICATIONS

Owen, J.M. and Rogers, R.H.; Flow and Heat Transfers in Rotating-Disc Systems; vol. 2; Rotating Cavities; 1995; pp. 152-156; Research Studies Press Ltd.; Taunton, UK.
Chew, J.W. et al.; The Use of Fins to Reduce the Pressure Drop in a Rotating Cavity With a Radial Inflow; Journal of Turbomachinery; Jul. 1989; pp. 349-356; vol. 111; Transactions of the ASME.
Owen, J.M. et al.; Prediction of Ingress Through Turbine Rim Seals. Part 2: Combined Ingress; Proceedings of ASME Turbo Expo 2010: Power for Land, Sea and Air; Jun. 14-18, 2010; pp. 1-11; GT2010-23349; Glasgow, UK.

(Continued)

*Primary Examiner* — Nathaniel Wiehe
*Assistant Examiner* — Woody A Lee, Jr.

(57) ABSTRACT

A seal assembly provided between a hot gas path and a disc cavity in a turbine engine includes an annular outer wing member extending from an axially facing side of a rotor structure toward an adjacent non-rotating vane assembly, and a plurality of fins extending radially inwardly from the outer wing member and extending toward the adjacent non-rotating vane assembly. The fins are arranged such that a space having a component in a circumferential direction is defined between adjacent fins. Rotation of the fins during operation of the engine effects a pumping of purge air from the disc cavity toward the hot gas path to assist in limiting hot working gas leakage from the hot gas path to the disc cavity by forcing the hot working gas away from the seal assembly.

20 Claims, 4 Drawing Sheets

(56) References Cited

OTHER PUBLICATIONS

Sangan, Carl M. et al.; Experimental Measurements of Ingestion Through Turbine Rim Seals. Part 1: Externally-Induced Ingress; Proceedings of ASME Turbo Expo 2011; Jun. 6-10, 2011; pp. 1-13; GT2011-45310; Vancouver, British Columbia, Canada.

Sangan, Carl M. et al.; Experimental Measurements of Ingestion Through Turbine Rim Seals. Part 2: Rotationally-Induced Ingress; Proceedings of ASME Turbo Expo 2011; Jun. 6-10, 2011; pp. 1-11; GT2011-45313; Vancouver, British Columbia, Canada.

* cited by examiner

FINNED SEAL ASSEMBLY FOR GAS TURBINE ENGINES

FIELD OF THE INVENTION

The present invention relates generally to a seal assembly for use in a turbine engine, and more particularly, to a seal assembly including a plurality of fins located radially inwardly from an annular outer wing member and that rotate with a turbine rotor for limiting leakage from a hot gas path to a disc cavity in the turbine engine.

BACKGROUND OF THE INVENTION

In multistage rotary machines such as gas turbine engines, a fluid, e.g., intake air, is compressed in a compressor and mixed with a fuel in a combustor. The combination of air and fuel is ignited to create combustion gases that define a hot working gas that is directed to turbine stage(s) to produce rotational motion of turbine components. Both the turbine stage(s) and the compressor have stationary or non-rotating components, such as vanes, for example, that cooperate with rotatable components, such as blades, for example, for compressing and expanding the hot working gas. Many components within the machines must be cooled by a cooling fluid to prevent the components from overheating.

Leakage of hot working gas from a hot gas path to disc cavities in the machines that contain cooling fluid reduces engine performance and efficiency, e.g., by yielding higher disc and blade root temperatures. Leakage of the working gas from the hot gas path to the disc cavities may also reduce service life and/or cause failure of the components in and around the disc cavities.

SUMMARY OF THE INVENTION

In accordance with a first aspect of the invention, a seal assembly is provided between a hot gas path and a disc cavity in a turbine engine including a rotor structure supporting a plurality of blades for rotation with a turbine rotor. The seal assembly comprises an annular outer wing member extending from an axially facing side of the rotor structure toward an adjacent non-rotating vane assembly, and a plurality of fins extending radially inwardly from the outer wing member and extending toward the adjacent non-rotating vane assembly. The fins are arranged such that a space having a component in a circumferential direction is defined between adjacent fins.

In accordance with a second aspect of the invention, a seal assembly is provided between a hot gas path and a disc cavity in a turbine engine including a rotor structure supporting a plurality of blades for rotation with a turbine rotor. The seal assembly comprises an annular outer wing member extending from an axially facing side of the rotor structure toward an adjacent non-rotating vane assembly, and a plurality of curved fins extending radially inwardly from the outer wing member and extending toward the adjacent non-rotating vane assembly. The fins are arranged such that a space having a component in a circumferential direction is defined between adjacent fins. Rotation of the fins during operation of the engine effects a pumping of purge air from the disc cavity toward the hot gas path to assist in limiting hot working gas leakage from the hot gas path to the disc cavity by forcing the hot working gas away from the seal assembly.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
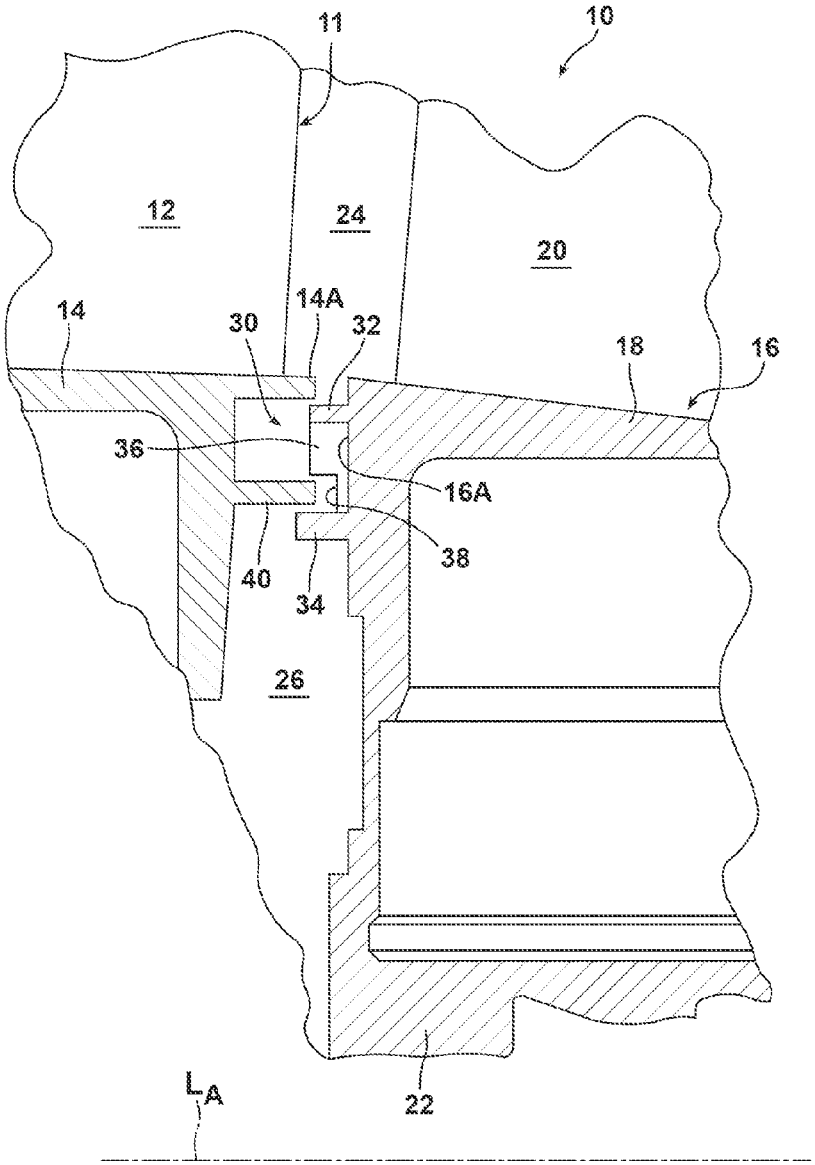
FIG. 1 is a diagrammatic sectional view of a portion of a gas turbine engine including a seal assembly in accordance with an embodiment of the invention.

Referring to FIG. 1, a portion of a turbine engine 10 is illustrated diagrammatically including alternating rows of stationary vane assemblies 11 including a plurality of vanes 12 suspended from an outer casing (not shown) and affixed to respective annular inner shrouds 14, and rotor structures 16 including platforms 18 and blades 20 that rotate with a turbine rotor disc 22 that forms a part of a turbine rotor. The vane assemblies 11 and the rotor structures 16 are positioned circumferentially within the engine 10 with alternating rows of vane assemblies 11 and rotor structures 16 located in an axial direction defining a longitudinal axis $L_A$ of the engine 10. The vane assembly 11 illustrated in FIG. 1 may be a row 1 vane assembly 11 within the engine 10, and the rotor structure 16 illustrated in FIG. 1 may be a row 1 rotor structure 16.

The vanes 12 and the blades 20 extend into an annular hot gas path 24 defined within the engine 10. A working gas comprising hot combustion gases is directed through the hot gas path 24 and flows past the vanes 12 and the blades 20 to remaining stages during operation of the engine 10. Passage of the working gas through the hot gas path 24 causes rotation of the blades 20 and the corresponding rotor structures 16 to provide rotation of the turbine rotor disc 22. As used herein, the term "rotor structure" may refer to any structure associated with the respective rotor structure 16 that rotates with the turbine rotor disc 22 during engine operation, e.g., the platforms 18, blades 20, roots, side plates, shanks, etc.

A disc cavity 26 illustrated in FIG. 1 is located radially inwardly from the hot gas path 24 between the annular inner shroud 14 and the rotor structure 16. Purge air, e.g., compressor discharge air, is provided into the disc cavity 26 to cool the rotor structure 16 and the annular inner shroud 14. The purge air also provides a pressure balance against the pressure of the working gas flowing in the hot gas path 24 to counteract a flow of the working gas into the disc cavity 26. The purge air may be provided to the disc cavity 26 from cooling passages (not shown) formed through the rotor disc 22 and/or from other upstream passages (not shown) as desired. It is noted that additional disc cavities (not shown) are typically provided between downstream annular inner shrouds and adjacent rotor structures.

Components on the rotor structure 16 and the annular inner shroud 14 radially inwardly from the respective blades 20 and vanes 12 cooperate to form an annular seal assembly 30. The annular seal assembly 30 creates a seal to substantially prevent leakage of the working gas from the hot gas path 24 into the disc cavity 26. It is noted that additional seal assemblies similar to the one to be described herein may be provided between rotor structures and inner shrouds of the remaining stages in the engine 10, i.e., for substantially preventing leakage of the working gas from the hot gas path 24 into the respective disc cavities.

Figure 2:
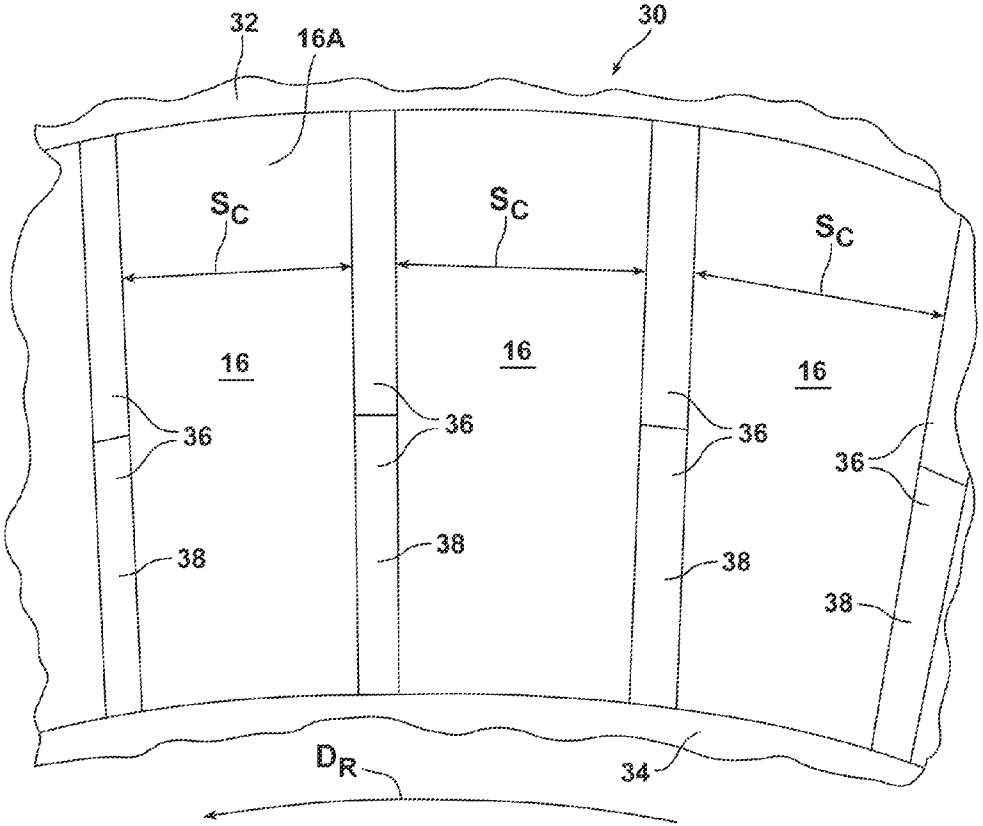
FIG. 2 is a fragmentary view looking in a direction parallel to a longitudinal axis of the gas turbine engine illustrating a portion of the seal assembly shown in FIG. 1.

Referring additionally to FIG. 2, the seal assembly 30 comprises an annular outer wing member 32 extending from an axially facing side 16A of the rotor structure 16 toward the adjacent non-rotating vane assembly 11. The outer wing member 32 may be formed as an integral part of the rotor structure 16 as shown in FIG. 1, or may be formed separately from the rotor structure 16 and affixed thereto. The illustrated outer wing member 32 is generally arcuate shaped in a circumferential direction when viewed axially, see FIG. 2. As shown in FIG. 1, the outer wing member 32 preferably axially overlaps a downstream end 14A of the annular inner shroud 14.

The seal assembly 30 further comprises an annular inner wing member 34 extending from the axially facing side 16A of the rotor structure 16 toward the adjacent vane assembly 11. The inner wing member 34 is located radially inwardly from the outer wing member 32 and may be formed as an integral part of the rotor structure 16 as shown in FIG. 1, or may be formed separately from the rotor structure 16 and affixed thereto. The inner wing member 34 may be generally arcuate shaped in the circumferential direction when viewed axially, see FIG. 2.

A plurality of fins 36 of the seal assembly 30 according to this embodiment extend generally radially inwardly from the outer wing member 32 toward the inner wing member 34 and preferably extend all the way to the inner wing member 34 as shown in FIGS. 1 and 2. The fins 36 extend axially toward the adjacent vane assembly 11 and are arranged such that a space $S_C$ having a component in the circumferential direction of the engine 10 is defined between adjacent fins 36, see FIG. 2. The size of the space $S_C$ may vary depending on the particular configuration of the engine 10 and may be related to the pitch distance associated with the number of blades 20 provided in the respective row.

As shown in FIGS. 1 and 2, the fins 36 according to this embodiment include a notch 38 that defines an axially extending recessed portion of each fin 36. The notch 38 of each fin 36 receives an annular seal member 40 of the seal assembly 30, see FIG. 1. The seal member 40 extends axially from the annular inner shroud 14 of the adjacent vane assembly 11 toward the rotor structure 16.

As shown in FIG. 1, the portions of the fins 36 that do not define the recessed portions, i.e., non-recessed portions of the fins 36, preferably extend axially a substantial axial length of the outer wing member 32, while the portions of the fins 36 that define the recessed portions preferably extend axially only a short distance from the axially facing side 16A of the rotor structure 16. Hence, in addition to the outer wing member 32 axially overlapping the downstream end 14A of the annular inner shroud 14, the outer and inner wing members 32, 34 and the non-recessed portions of the fins 36 axially overlap the seal member 40, such that any leakage from the hot gas path 24 into the disc cavity 26 must travel through a tortuous path.

During operation of the engine 10, passage of the hot working gas through the hot gas path 24 causes the rotor disc 22 and the rotor structure 16 to rotate in a direction of rotation $D_R$ shown in FIG. 2.

Rotation of the fins 36 along with the rotor structure 16 effects a pumping of purge air from the disc cavity 26 toward the hot gas path 24 to assist in limiting hot working gas leakage from the hot gas path 24 to the disc cavity 26 by forcing the hot working gas away from the seal assembly 30. Since the seal assembly 30 limits hot working gas leakage from the hot gas path 24 to the disc cavity 26, the seal assembly 30 correspondingly allows for a smaller amount of purge air to be provided to the disc cavity 26, thus increasing engine efficiency. Moreover, the fins 36 provide additional swirl velocity to the flow contained within the disc cavity 26 by increasing the effective surface area of rotating components, thus reducing the aerodynamic loss associated with the purge flow introduction into the hot gas path 24. The rotation of the fins 36 also dampens the pressure asymmetries created by the vane assemblies 11 and the rotor structures 16 and to reduce heat transfer on the surfaces of the rotating components near the seal assembly 30. Further, the fins 36 are believed to promote attachment of the purge air that is pumped from the disc cavity 26 to the rotating rotor structure 16 so as to provide cooling for the rotor structure 16.

It is noted that, while the fins 36 illustrated in FIGS. 1 and 2 are shown as extending generally radially from the outer wing member 32 to the inner wing member 34, the fins 36 could be angled in a direction toward or away from the direction of rotation $D_R$ of the rotor disc 22 to fine tune the amount of purge air that is pumped out of the disc cavity 26. The angling of the fins 36 may also be adjusted to create a preferred swirl for the purge air that is pumped out of the cavity 26, e.g., such that the swirl of the purge air pumped out of the disc cavity 26 is able to be more closely matched to a swirl of the hot working gas flowing near the seal assembly 30 to effect a better aerodynamic efficiency.

Figure 3:
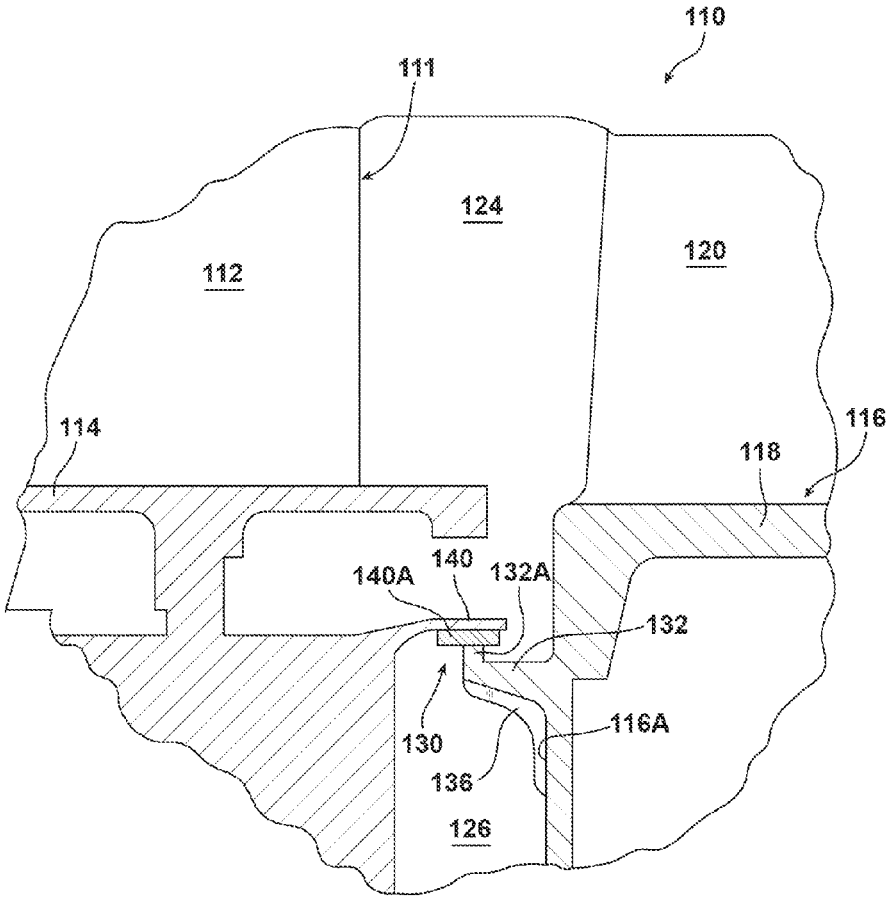
FIG. 3 is a diagrammatic sectional view of a portion of a gas turbine engine including a seal assembly in accordance with another embodiment of the invention.
Figure 4:
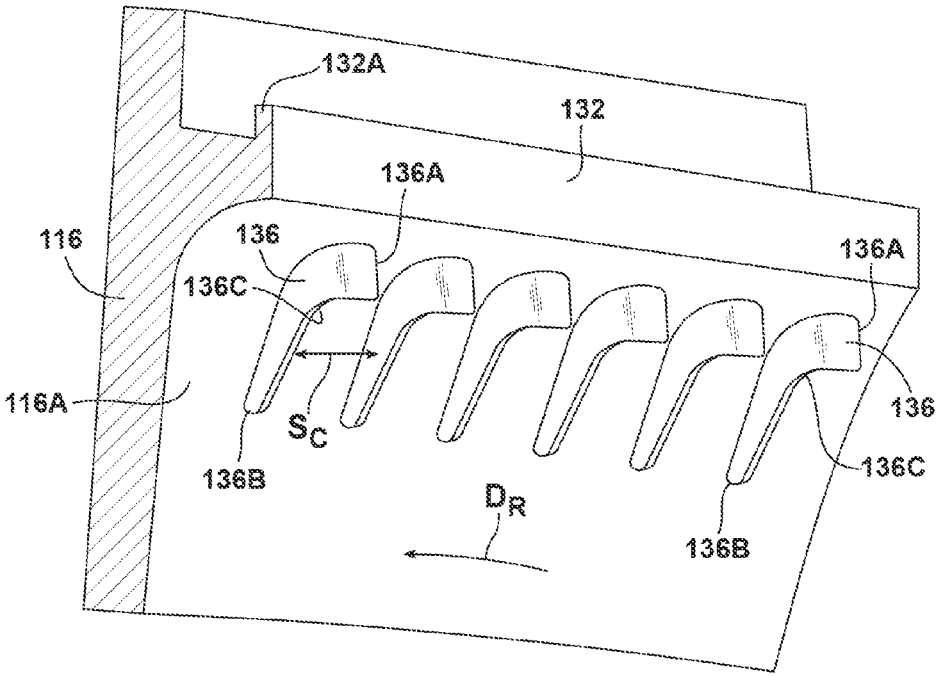
FIG. 4 is a partial perspective view illustrating a portion of the seal assembly illustrated in FIG. 3.

Referring now to FIGS. 3 and 4, a seal assembly 130 according to another embodiment is shown, where structure similar to that described above with reference to FIGS. 1 and 2 includes the same reference number increased by 100.

The seal assembly 130 according to this embodiment includes an annular outer wing member 132 that extends from an axially facing side 116A of a rotor structure 116 toward an upstream vane assembly 111, an annular seal member 140 that extends axially toward the rotor structure 116 from an inner shroud 114 of the upstream vane assembly 111, and a plurality of curved fins 136.

The curved fins 136 according to this embodiment extend radially inwardly from the outer wing member 132 and extend axially a substantial axial length of the outer wing member 132, see FIG. 3. The fins 136 are arranged such that a space $S_C$ having a component in the circumferential direction of the engine 110 is defined between adjacent fins 136, see FIG. 4. The size of the space $S_C$ may vary depending on the particular configuration of the engine 110 and may be related to the pitch distance associated with the number of blades 120 provided in the respective row.

As shown in FIG. 4, the fins 136 according to this embodiment are curved in the circumferential direction between a radially outer end 136A thereof and a radially inner end 1368 thereof. In the embodiment shown in FIG. 4, a concave side 136C of each of the curved fins 136 faces a direction opposite to a direction of rotation $D_R$ of the turbine rotor and the rotor structure 116. It is understood that while only the portions of the fins 136 located near the radially outer ends 136A are curved in the embodiment shown, the entire lengths of the fins 136 could be curved, or one or more other portions of the fins 136 may be curved. Further, the fins 136 could extend a greater or lesser amount radially inwardly along the axially facing side 116A of the rotor structure 116 than as shown in FIGS. 3 and 4.

As shown in FIG. 4, the radially outer end 136A of each fin 136 according to this embodiment is located upstream from the radially inner end 1368 of the respective fin 136 with respect to the direction of rotation $D_R$ of the turbine rotor and the rotor structure 116. However, it is noted that the radially outer end 136A of each fin 136 could be located downstream from the radially inner end 1368 of the respective fin 136 or substantially in plane with the radially inner end 1368 of the respective fin 136 with respect to the direction of rotation $D_R$ of the turbine rotor and the rotor structure 116.

As with the embodiment described above with reference to FIGS. 1 and 2, rotation of the fins 136 along with the rotor structure 116 effects a pumping of purge air from the disc cavity 126 to the hot gas path 124 to assist in limiting hot working gas leakage from the hot gas path 124 to the disc cavity 126 by forcing the hot working gas away from the seal assembly 130. Further, the outer wing member 132 according to this embodiment may include a radially outwardly extending flange 132A that extends radially toward a radially inwardly extending flange 140A of the vane assembly seal member 140 to create a smaller leakage path between the seal assembly components. The flange 140A of the vane assembly seal member 140 may comprise an abradable material in the case of rubbing contact with the outer wing member flange 132A.

It is noted that the curved fins 136 illustrated in FIGS. 3 and 4 could be used in the place of the fins 36 of the seal assembly 30 described above with reference to FIGS. 1 and 2. Such curved fins 136 could include notches for receiving the annular seal member 40 of the vane assembly 11, as shown in FIGS. 1 and 2. Moreover, the fins 36, the annular inner wing member 34, and the annular seal member 40 illustrated in FIGS. 1 and 2 could be employed in the seal assembly 130 of FIGS. 3 and 4, wherein the vane assembly 111 could include the illustrated seal member 140 of FIGS. 3 and 4 and an additional seal member, i.e., the seal member 40 of FIGS. 1 and 2, which extends into notches formed in the fins.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A seal assembly between a hot gas path and a disc cavity in a turbine engine including a rotor structure supporting a plurality of blades for rotation with a turbine rotor, the seal assembly comprising:

an annular outer wing member extending from an axially facing side of the rotor structure toward an adjacent non-rotating vane assembly; and a plurality of fins extending radially inwardly from the outer wing member and extending toward the adjacent non-rotating vane assembly, the fins being arranged such that a space having a component in a circumferential direction is defined between adjacent fins.

2. The seal assembly according to claim 1, further comprising an annular inner wing member located radially inwardly from the fins.

3. The seal assembly according to claim 2, wherein the fins extend radially from the outer wing member to the inner wing member.

4. The seal assembly according to claim 3, wherein the fins include a notch defining an axially extending recessed portion, the notch of each fin receiving an annular seal member that extends axially from the adjacent non-rotating vane assembly toward the rotor structure.

5. The seal assembly according to claim 4, wherein at least one of the inner and outer wing members overlaps the seal member.

6. The seal assembly according to claim 4, wherein the fins and the inner wing member overlap the seal member.

7. The seal assembly according to claim 1, wherein rotation of the fins during operation of the engine effects a pumping of purge air from the disc cavity toward the hot gas path to assist in limiting hot working gas leakage from the hot gas path to the disc cavity by forcing the hot working gas away from the seal assembly.

8. The seal assembly according to claim 1, wherein the fins are curved in the circumferential direction between a radially outer end of each fin and a radially inner end of each fin.

9. The seal assembly according to claim 8, wherein concave sides of the curved fins face a direction opposite to a direction of rotation of the turbine rotor.

10. The seal assembly according to claim 9, wherein the radially outer ends of the fins are located upstream from the radially inner ends of the fins with respect to the direction of rotation of the turbine rotor.

11. The seal assembly according to claim 1, wherein the fins extend axially a substantial axial length of the outer wing member.

12. The seal assembly according to claim 1, wherein the rotor structure is a row 1 rotor structure in the turbine engine and the vane assembly is a row 1 vane assembly in the turbine engine.

13. A seal assembly between a hot gas path and a disc cavity in a turbine engine including a rotor structure supporting a plurality of blades for rotation with a turbine rotor, the seal assembly comprising:

an annular outer wing member extending from an axially facing side of the rotor structure toward an adjacent non-rotating vane assembly; and a plurality of curved fins extending radially inwardly from the outer wing member and extending toward the adjacent non-rotating vane assembly, the fins being arranged such that a space having a component in a circumferential direction is defined between adjacent fins, wherein rotation of the fins during operation of the engine effects a pumping of purge air from the disc cavity toward the hot gas path to assist in limiting hot working gas leakage from the hot gas path to the disc cavity by forcing the hot working gas away from the seal assembly.

14. The seal assembly according to claim 13, further comprising an annular inner wing member located radially inwardly from the fins.

15. The seal assembly according to claim 14, wherein the fins extend radially from the outer wing member to the inner wing member.

16. The seal assembly according to claim 14, wherein the fins include a notch defining an axially extending recessed portion, the notch of each fin receiving an annular seal member that extends axially from the adjacent non-rotating vane assembly toward the rotor structure.

17. The seal assembly according to claim 16, wherein at least one of the inner and outer wing members overlaps the seal member.

18. The seal assembly according to claim 13, wherein concave sides of the curved fins face a direction opposite to a direction of rotation of the turbine rotor.

19. The seal assembly according to claim 18, wherein radially outer ends of the fins are located upstream from radially inner ends of the fins with respect to the direction of rotation of the turbine rotor.

20. The seal assembly according to claim 13, wherein the rotor structure is a row 1 rotor structure in the turbine engine and the vane assembly is a row 1 vane assembly in the turbine engine.

* * * * *